US008783477B2

(12) United States Patent
Camacho et al.

(10) Patent No.: US 8,783,477 B2
(45) Date of Patent: Jul. 22, 2014

(54) LIGHTWEIGHT HIGH-PERFORMANCE PIPELAYER

(75) Inventors: Timothy E. Camacho, Morton, IL (US); Kory D. Gerbick, Metamora, IL (US); Kevin J. Klein, Metamora, IL (US); Kent D. Smith, Mapleton, IL (US); Jonathan R. Whitehead, Normal, IL (US)

(73) Assignee: Caterpillar Inc., Peoria, IL (US)

( * ) Notice: Subject to any disclaimer, the term of this patent is extended or adjusted under 35 U.S.C. 154(b) by 934 days.

(21) Appl. No.: 12/893,641

(22) Filed: Sep. 29, 2010

(65) Prior Publication Data

US 2011/0084044 A1 Apr. 14, 2011

Related U.S. Application Data

(60) Provisional application No. 61/249,828, filed on Oct. 8, 2009.

(51) Int. Cl.
*B66C 13/18* (2006.01)

(52) U.S. Cl.
USPC ..... 212/279; 212/196; 212/258

(58) Field of Classification Search
USPC ..... 212/195, 196, 197, 198, 278, 279, 258
See application file for complete search history.

(56) References Cited

U.S. PATENT DOCUMENTS

| | | | | |
|---|---|---|---|---|
| 2,722,320 | A | 11/1955 | Dobeus et al. | |
| 3,266,636 | A | 8/1966 | Dorn | |
| 3,598,347 | A * | 8/1971 | Marburger | 248/654 |
| 3,740,534 | A * | 6/1973 | Kezer et al. | 701/50 |
| 3,785,503 | A * | 1/1974 | Butterfield et al. | 212/289 |
| 3,815,116 | A * | 6/1974 | Fink | 340/666 |
| 3,819,922 | A * | 6/1974 | Horn et al. | 701/50 |
| 3,938,669 | A * | 2/1976 | Vinton | 212/272 |
| 4,083,459 | A | 4/1978 | Allen | |
| 4,132,317 | A * | 1/1979 | Arendt et al. | 212/301 |
| 4,236,864 | A * | 12/1980 | Couture et al. | 414/699 |
| 4,279,348 | A * | 7/1981 | Harper et al. | 212/196 |
| 5,332,110 | A * | 7/1994 | Forsyth | 212/258 |
| 5,992,655 | A * | 11/1999 | Greenberg et al. | 212/258 |

(Continued)

FOREIGN PATENT DOCUMENTS

| | | | |
|---|---|---|---|
| EP | 1221426 A2 * | 7/2002 | B66C 15/06 |
| JP | 06171892 | 6/1994 | |
| JP | 07108959 | 4/1995 | |

(Continued)

*Primary Examiner* — Emmanuel M Marcelo
(74) *Attorney, Agent, or Firm* — Miller, Matthias & Hull; John P. Wappel

(57) ABSTRACT

A pipelayer providing higher lifting capacities without adding weight or size to an undercarriage or boom of the pipelayer is disclosed. The pipelayer is designed and sized to have a maximum lifting capacity when the boom is extended from the undercarriage a predetermined, relatively short distance. However, in use the boom often needs to extend further away from the undercarriage, and in so doing the lifting capacity of the pipelayer decreases. The present disclosure provides additional lifting capacity in that extended range by selectively deploying a counterweight away from the undercarriage once the boom is extended past the predetermined distance. In so doing, not only is the lifting capacity of the pipelayer increased, but the size and weight of the undercarriage and boom are not increased. This enables standard sized undercarriages and other supporting structure to be used, thereby aiding in maneuverability and shipping of the pipelayers, while at the same time reducing manufacturing and usage costs.

28 Claims, 6 Drawing Sheets

(56) References Cited

U.S. PATENT DOCUMENTS

| | | | | |
|---|---|---|---|---|
| 6,000,563 | A | 12/1999 | Greenberg | |
| 7,845,503 | B2 * | 12/2010 | Laurini | 212/197 |
| 7,896,178 | B2 * | 3/2011 | Davis | 212/178 |
| 2003/0090384 | A1 * | 5/2003 | Nishimura et al. | 340/685 |
| 2008/0203045 | A1 * | 8/2008 | Pech et al. | 212/270 |
| 2009/0297275 | A1 * | 12/2009 | Davis | 405/174 |

FOREIGN PATENT DOCUMENTS

| | | |
|---|---|---|
| KR | 200289733 | 9/2002 |
| KR | 200378379 | 3/2005 |
| KR | 1020050072842 | 7/2005 |

* cited by examiner

FIG. 2
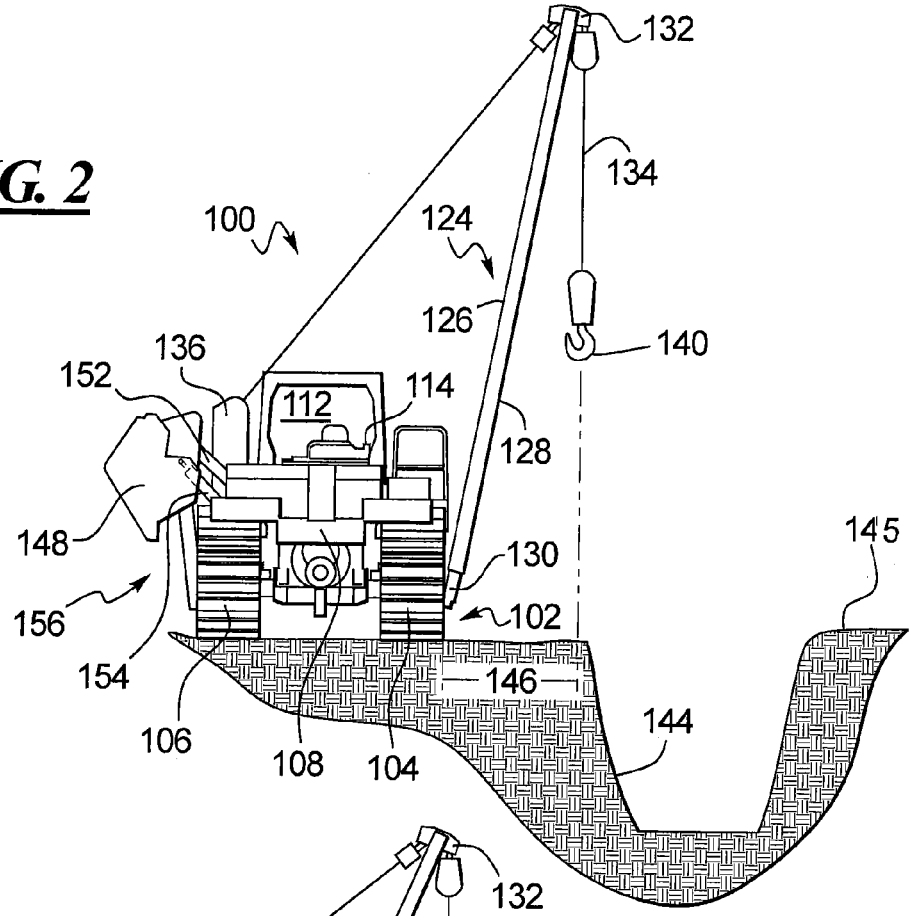
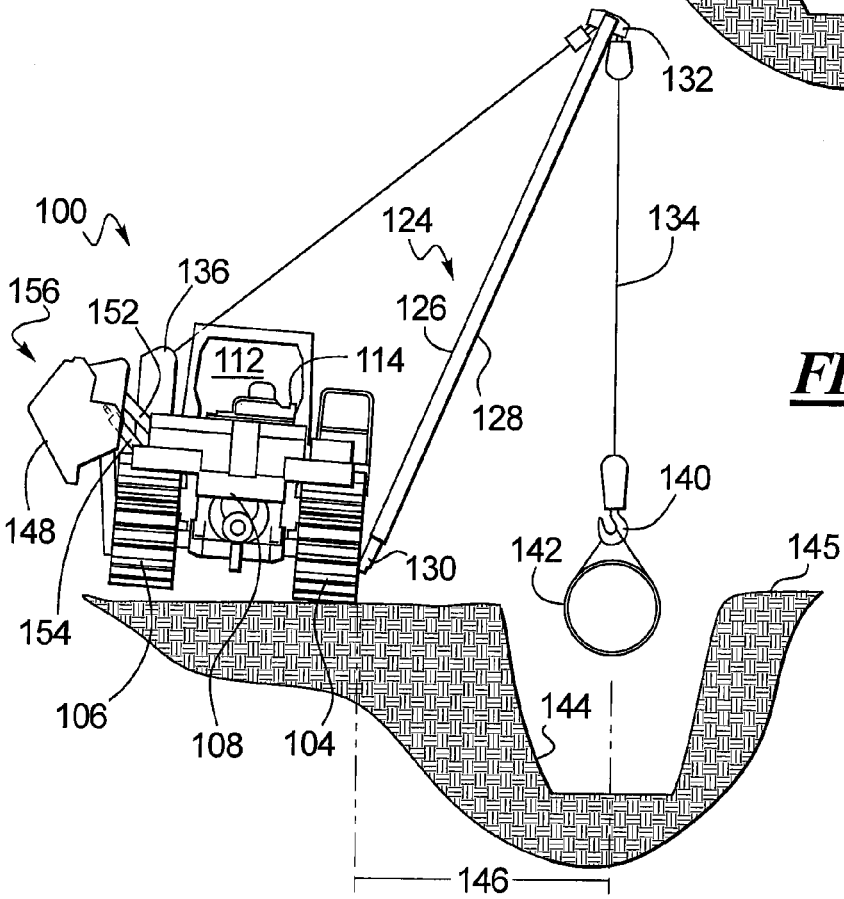
FIG. 3

LIGHTWEIGHT HIGH-PERFORMANCE PIPELAYER

CROSS-REFERENCE TO RELATED APPLICATION

This is a non-provisional application claiming priority under 35 USC §119 (e) to U.S. Provisional Patent Application No. 61/249,828 filed on Oct. 8, 2009.

TECHNICAL FIELD

The present disclosure generally relates to construction vehicles and, more particularly, relates to pipelayers.

BACKGROUND

Pipelayers are specialized vehicles used for installing large, heavy lengths of conduit into or above ground. Such conduits may be used, for example, to carry oil and gas from remote well locations over vast distances to a receiving station or refinery. In so doing, transportation costs for shipping, trucking or otherwise moving the oil and gas can be avoided. In addition to petroleum pipelines, pipelayers can also be used to install piping for other materials, or for installing of drain tile, culverts or other irrigation and drainage structure.

However, the installation of such pipelines is often very challenging. The locations of such oil and gas wells are commonly some of the most remote areas on earth, and the terrain over which the pipeline must traverse is often some of the most rugged. The climate of the installations can have very high or very low temperatures. The land may have significant elevational changes, and be subject to mudslides, severe weather, deep forestation and the like. In order to install the pipe, the pipelayer must be able to operate in all of the above-climate conditions, navigate over such terrain, and still be able to lift loads often in excess of 200,000 pounds.

Not only must pipelayers be able to handle such tasks, but given that the pipes are installed in long segments welded or otherwise secured together, they must be installed with great precision. The ends of the pipe being welded together must butt up against each other within a very tight tolerance. In addition, the pipes are often installed in connected fashion. This can result in a very long length of conduit (sometimes exceeding a mile) which must be laid into the ground in coordinated fashion. A series of pipelayers in such a situation will therefore be called upon to work in concert to lay the pipe.

When installing pipelines, if a natural or pre-made easement does not exist, a path through the terrain is first cleared through the forest, mountain pass or other geographical challenge at hand. A trench is then dug to the desired size, which is typically many feet deep and many feet wide. A right-of-way is also provided to one or both sides of the trench to allow for passage of trucks to transport the pipe into the location, and for passage of pipelayers to install the pipe. This right-of-way is ideally flat and sufficiently wide to easily accommodate the pipelayer but given the constraints imposed by the area topography and space availabilities of the local region or country, this may not always be the case. Pipelayers therefore often need to carry not only very heavy loads, but do so without being on level, stable ground.

Current pipelayers typically work on a track-type undercarriage and operate with a side-boom that can be extended at a variable angle to the chassis of the pipelayer. A cable is trained from a winch or other power source through a series of pulleys and terminates in a grapple hook or other suitable terminus. The grapple hook or other suitable terminus can then be secured to the pipe in such a way that when the winch recoils, the pipe is lifted. The boom arm is then extended and the pipelayer itself is navigated to a desired location for accurate installation of the pipe.

While effective, it can be seen that the weight of the pipe is positioned in cantilevered fashion away from the chassis, engine and undercarriage of the pipelayer. As the chassis, engine and undercarriage comprise the majority of the weight of a pipelayer, depending on the weight of the pipe being lifted and the length of the boom arm, the pipelayer can be subject to potential tipping and instability. Conversely, if the pipelayer is to be maintained in a stable position, the ability of the pipelayer to access the desired installation location can be significantly limited.

To offset these concerns, current pipelayers typically include a counterweight. The counterweight may comprise a series of heavy plates secured to a hinged structure such that through the use of a hydraulic cylinder or the like, the counterweight can be swung away from the chassis of the pipelayer on the side of the pipelayer opposite to the boom and thus counterbalance the weight of the load being lifted.

However, the counterweight systems of currently available pipelayers are operated entirely at the discretion of the operator and thus are arbitrarily applied. The operator of the pipelayer is able to extend the counterweight as he or she sees fit without regard to optimizing lifting capacity or stability of the pipelayer. Often, the counterweight is simply extended and left in that position during operation of the pipelayer. The lifting capacity and possible boom angle are therefore largely limited by such a fixed system.

Current demands being placed on pipelayer design, moreover, are requiring higher lifting capacities and boom lengths/angles. The pipelayer could in theory simply be made larger and heavier to satisfy these needs, but realistically the general footprint of the pipelayer is limited by cost, maneuverability, and transportation considerations. As stated above, pipelayers need to be operated in very remote and difficult locations. Once built, they need to be sent by rail and/or truck for use, and thus the size of those rails and trucks limit the upper end in terms of dimensions of overall pipelayer design. Even if they could be shipped to the location, they also have to be nimble enough to perform the job. Moreover, over-sizing the undercarriage and boom of the pipelayer will also increase manufacturing costs in terms of materials, and operating costs in terms of fuel.

SUMMARY OF THE DISCLOSURE

In accordance with one aspect of the disclosure, a pipelayer is therefore disclosed which comprises an undercarriage, a boom movable relative to the undercarriage, and a counterweight movable relative to the undercarriage ranging between fully deployed and fully retracted positions, the counterweight being movable to the fully deployed position only when the boom has extended a predetermined distance from the undercarriage.

In accordance with another aspect of the disclosure, a method of operating a pipelayer is disclosed, which comprises extending a boom away from an undercarriage, measuring the distance the boom is extended away from the undercarriage, and deploying the counterweight only when the measured distance is greater than a predetermined length.

In accordance with a further aspect of the disclosure, a heavy lift assembly for a pipelayer is disclosed which comprises a position sensor adapted to measure a parameter indicative of the distance a boom is extended away from an undercarriage of the pipelayer, a processor receiving the measured parameter signal indicative of boom extension distance from the position sensor, and an operator interface connected to the processor and provided with an input device through which an operator can engage the heavy lift assembly, wherein the input device is actuable only when the boom has extended away from the undercarriage by a predetermined distance.

In accordance with a still further aspect of the disclosure, in a pipelayer having an undercarriage, chassis and boom weight of A and a machine maximum lifting capacity of B, a heavy lift attachment is disclosed which is adapted to increase the machine maximum lifting capacity to a value greater than B within a heavy lift operating range while maintaining the machine weight as A.

BRIEF DESCRIPTION OF THE DRAWINGS

FIG. 2 is a front view of a pipelayer relative to a trench in which pipe is being laid, and with a boom of the pipelayer extended to a distance providing the pipelayer with maximum lifting capacity;

FIG. 3 is a front view of the pipelayer similar to FIG. 2, but showing the pipelayer boom extended to a normal operating distance and causing the pipelayer to start to tilt;

DETAILED DESCRIPTION

Figure 1:
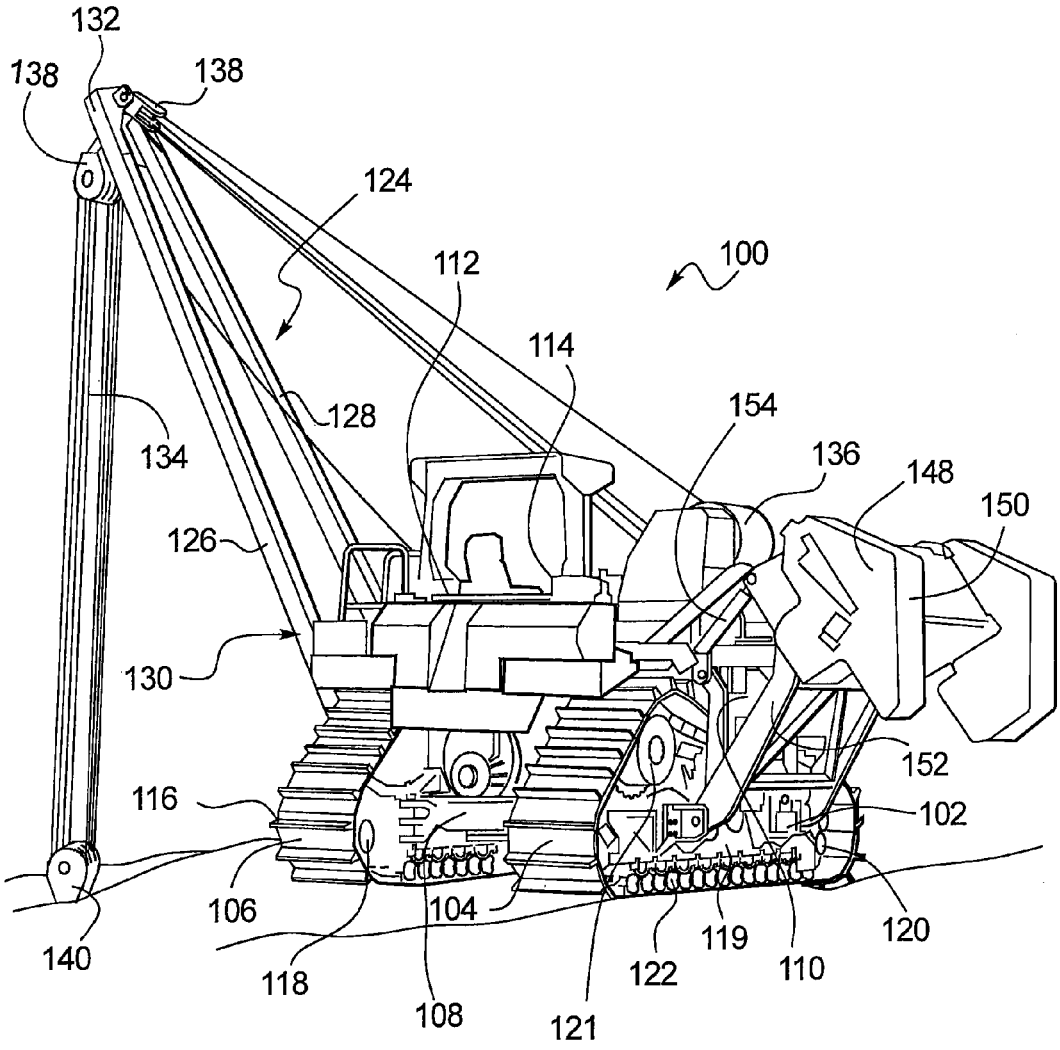
FIG. 1 is an isometric view of pipelayer constructed in accordance with the teachings of this disclosure.

Referring now to the drawings, and with specific reference to FIG. 1, a pipelayer constructed in accordance with the present disclosure is generally referred to by reference numeral 100. While the following detailed description and drawings are made with reference to a pipelayer, it is important to note that the teachings of this disclosure can be employed on other earth moving or construction machines including, but not limited to, loaders, back-hoes, lift-trucks, cherry-pickers, forklifts, excavators, or any other movable vehicle where a load is being lifted at a distance from the main body of the vehicle.

The pipelayer 100 may include an undercarriage 102 comprised of first and second drive tracks 104, 106 supporting a chassis 108. A power source, typically a diesel engine, 110 is supported by the chassis 108. An operator seat 112 and control console 114 may also be supported by the chassis 108 from which the operator can control one or both tracks 104 and 106 to drive the pipelayer 100 forward, backward and turn. Each of the tracks 104, 106 may be composed of a series of interlinked track shoes 116 in an oval track or high drive configuration. As shown, the tracks 104, 106 may be trained around first and second idlers 118, 120 supported by a track roller frame 119, a sprocket 121, as well as a series of other rollers 122 in a high-drive configuration.

Extending relative to the undercarriage is a boom 124. The boom 124 may include first and second legs 126, 128 independently hinged to the undercarriage 102 at a base 130, and which terminate at a joined tip 132. The boom 124 may be up any length desired, with up to twenty-eight or more feet long being suitable. A lifting cable(s) 134 extends from a winch 136 through a series of sheaves 138 at the boom tip 132 and terminates in a grapple hook 140, vacuum lift (not shown) or are other suitable arrangement for wrapping around or otherwise securing to a pipe 142 (FIGS. 2-4) to be lifted.

In operation, FIGS. 2 and 3 show that the pipelayer 100 is typically navigated by tracks 104, 106 to be adjacent a trench 144 pre-dug into ground 145. More precisely, the pipelayer 100 should be positioned away from the trench 144 according to applicable regulations. Once in such a position, the boom 124 may be extended away from the undercarriage 102 to facilitate lifting the pipe 142 and laying same into the trench 144. For the purposes of this disclosure, the distance that the boom 124 is extended away from the undercarriage 102, specifically the distance the tip 132 is extended away from the roller 122, will be referred to as overhang 146.

However, as shown in FIG. 2, the pipelayer 100 has its greatest lifting capacity when the boom 124 is extended away from the undercarriage 102 by an overhang 146 of zero to four feet. This distance gives the pipelayer its shortest tipping point, and thus the counterweight its maximum mechanical advantage. Current pipelayers are provided with myriad different lifting capacities, with 40,000; 90,000; 140,000 and 200,000 pound lifting capacities being examples. However, with the direction of the industry gaining momentum to put larger, heavier pipe in the ground, machines with even larger lifting capacities are desired. Regardless of the maximum lifting capacity of the given pipelayer, it is to be understood that the entire pipelayer 100, including the undercarriage 102, boom 124, and engine 110, as dictated by current ISO (International Organization for Standardization) standards need to be designed and engineered to handle that load. This is true even though that maximum lifting capacity is not often called for, the importance of which will be discussed in further detail herein.

Referring now to FIG. 3, it will be seen that the boom 124 has been extended to a much greater overhang 146. In fact, in such a position the weight of the pipe 142, length of the boom 124 and the overhang 146 may create a moment great enough to overcome the weight of the pipelayer undercarriage 102, engine 104 and associated machinery, and thereby start to cause the pipelayer 100 to tilt. As a result of this and other factors, in the position of FIG. 3, the lifting capacity and stability of the pipelayer 100 are significantly diminished. However, given the diameter of the pipe 142 and the relative dimensions of the trench 144 and pipelayer 100, the operator has no choice but to extend the boom 124 to an overhang 146 at which the lifting capacity and stability of the pipelayer 100 are less than maximum. In other words, as the pipe 142 may itself have a diameter of, for example, three or four feet, and the pipelayer 100 is required to be a minimum of the depth of the trench 144 away from the trench 144, the overhang 146 of the boom 124 in normal operation is may be well past the point of maximum lifting capacity.

Figure 4:
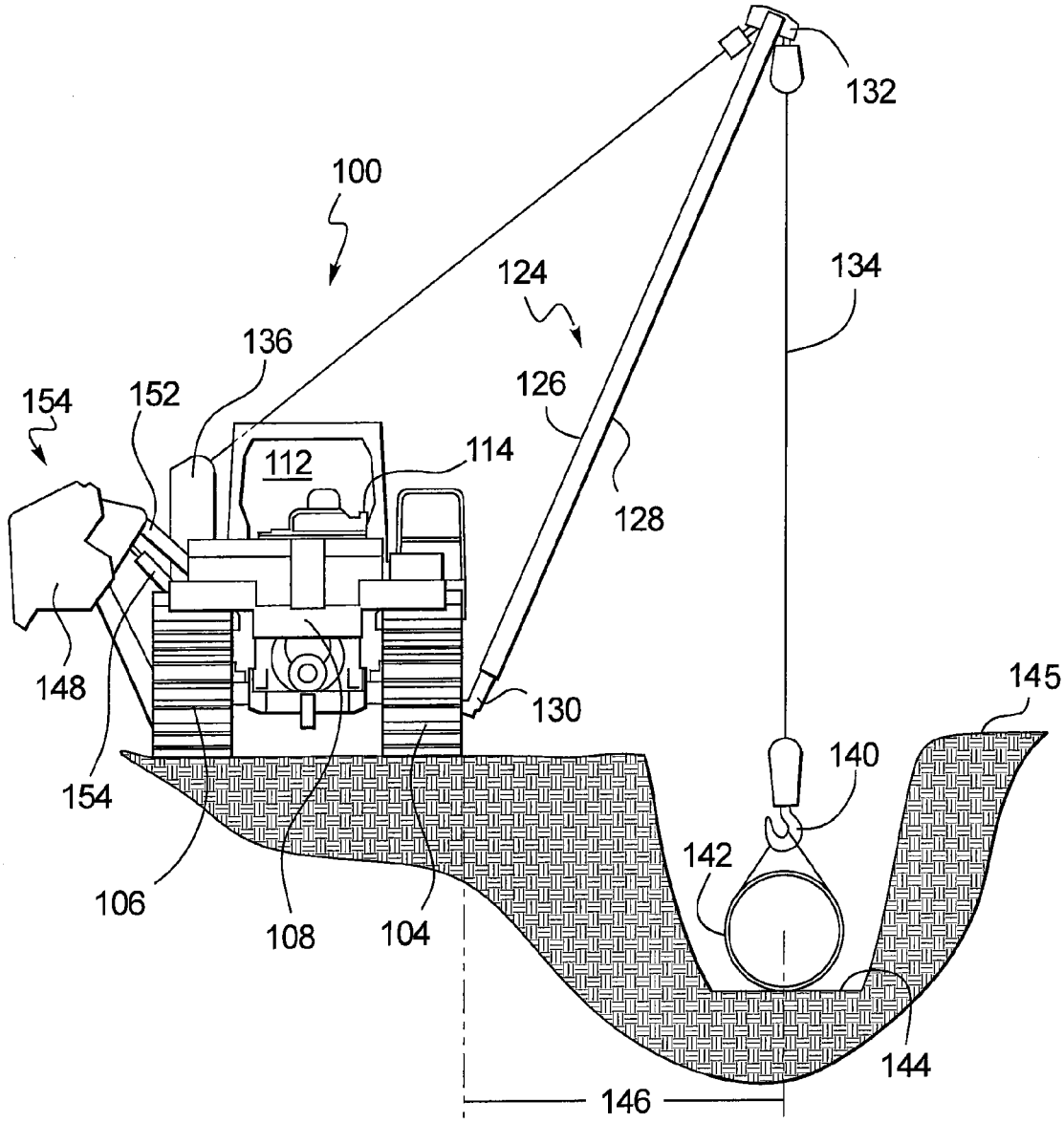
FIG. 4 is a front view of the pipelayer similar to FIG. 3, but showing a heavy lift attachment of the pipelayer deployed to counterbalance the load being lifted

In order to offset the moment created in FIG. 3, a counterweight 148 can be extended in a direction laterally opposite to the boom 124 as shown best in FIG. 4. The counterweight 148 may be comprised of a series of heavy plates 150 (see FIG. 1) secured to a counterweight frame 152. The counterweight frame 152 may be hingedly attached to the undercarriage 102 and/or chassis 108 and be movable between the retracted position of FIGS. 2 and 3, and the deployed position of FIG.

4, or anywhere in between by way of a hydraulic cylinder 154 or the like. In so doing the center of gravity of the pipelayer 100 is moved laterally away from the trench 144, thus balancing the pipelayer 100.

However, while this approach is effective, it has significant practical limitations. In theory, if the lifting capacity of the pipelayer 100 is to be increased, the overall size of the undercarriage 102, length and strength of the boom 124, horsepower of the engine 110, power of the hydraulic system 154 and winch 136 can all be increased to supply the lifting capacity needed. In practice however, this could easily result in a pipelayer which is either too big to manufacture cost-effectively, too big to ship on existing rail systems and roadways, too bulky to maneuver on the challenging terrain mentioned above, or too expensive to operate in terms of fuel consumption.

The present disclosure therefore sets forth an apparatus and method by which the lifting capacity of the pipelayer 100 is increased without increasing the size or cost of the undercarriage 102, boom 124, engine 110 or the like. The present disclosure does so by, among other things, providing additional counterweight 148, but only allowing deployment of the counterweight 148 after the boom 124 has been extended a predetermined distance. More specifically, the pipelayer 100 monitors the position of the boom 124 and enables deployment of the counterweight 148 in a smart, closed-loop fashion. A heavy-lift attachment (HLA) 156 may be used to do so as either part of a newly constructed pipelayer 100 or as a retrofit to existing pipelayers. As used herein, HLA is defined as a collection of components which can be added to a pipelayer 100 to increase the lifting capacity of the pipelayer across a predetermined overhang range without increasing the size of the undercarriage 102, chassis 108, boom 124, or engine 110.

Figure 6:
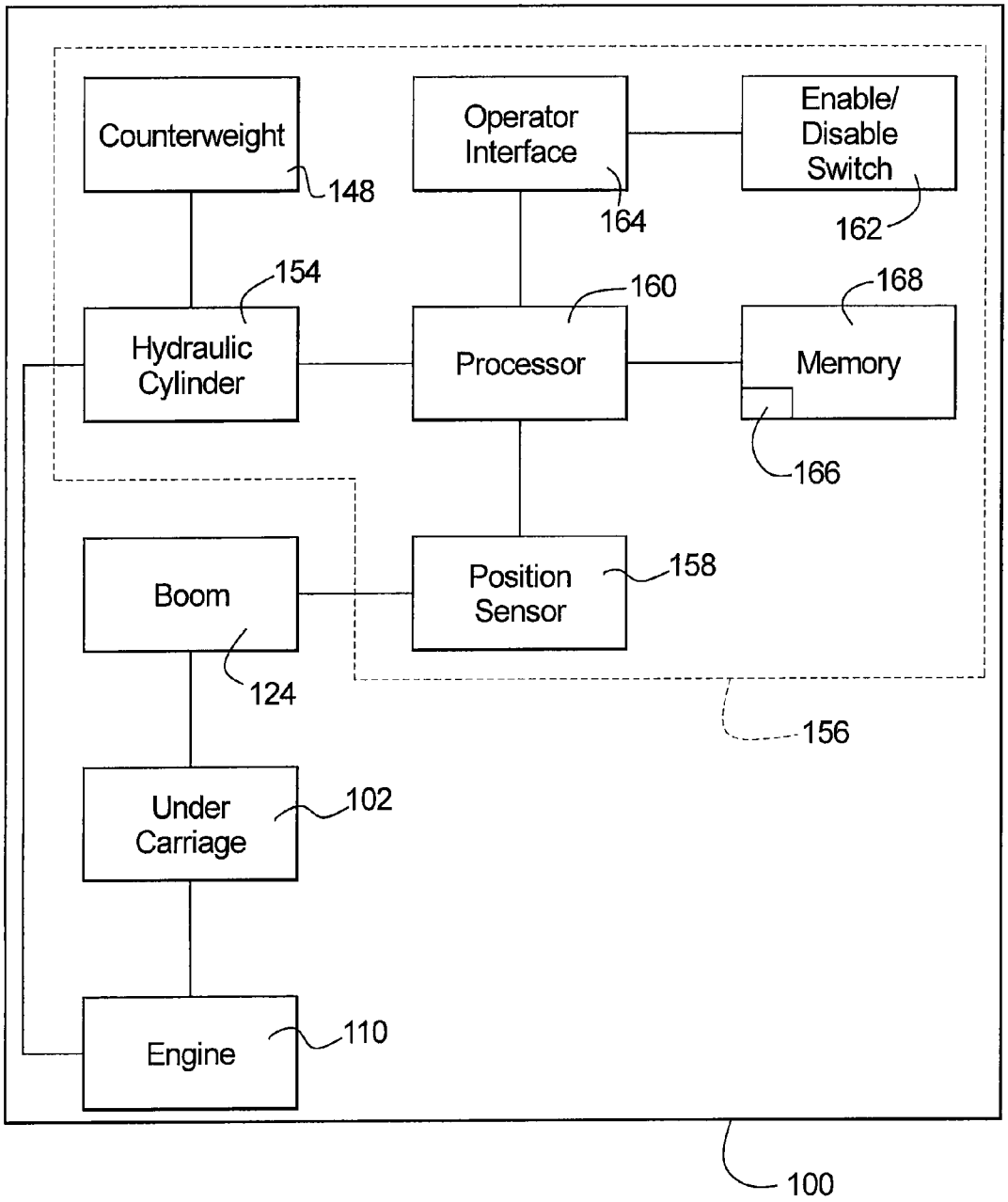
FIG. 6 is a schematic representation of the present disclosure.

As shown in FIG. 6, the HLA 156 may include a position sensor 158 which measures a parameter indicative of the overhang distance 146. The sensor 158 may be provided in any number of forms including, but not limited to, an encoder provided on a rotating shaft of the boom or winch, a rotary sensor, a magnetic sensor, a proximity switch or the like. One of ordinary skill in the art will understand the various types of sensors which can be used to monitor the angular position of the boom 124 or overhang distance 146 and generate a signal indicative of same.

As shown in FIG. 6, the HLA 156 may also include a processor 160 electronically communicating with the position sensor 158, and an enable/disable/automatic switch 162 also in communication with the processor 160. The enable/disable/automatic switch 162 may be integrated into an existing operator interface 164 on the control console 114 such as with a control screen or the like, or may be provided as a stand-alone switch added to the control console 114. The HLA 156 may also include software 166 electronically stored in a memory 168 also in electronic communication with the processor 160. The operator may also be given the opportunity to have the processor 160 automatically control the HLA 156.

Figure 5:
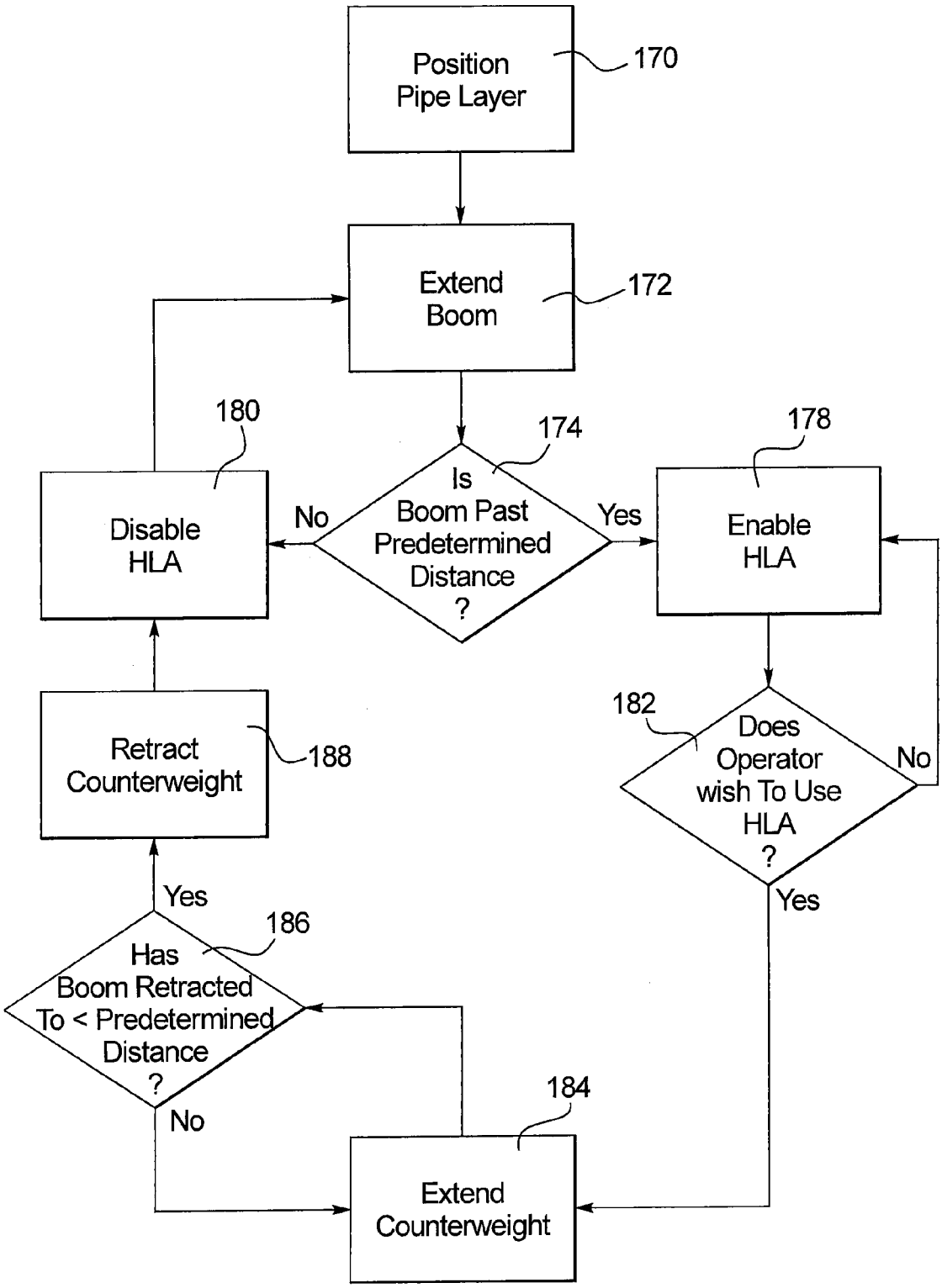
FIG. 5 is a flowchart depicting a sample sequence of steps which may be practiced according to the method of the present disclosure.

In operation, the pipelayer 100 may work as set forth in the flowchart of FIG. 5. As shown, the operator would navigate the pipelayer 100 to be adjacent the trench 144 with the pipe 142 secured to cable 134 as shown by a step 170. The boom 124 would then be extended (step 172) away from the undercarriage 102 to an overhang distance 146 at which the radial center of the pipe 142 is directly over the centerline of the trench 144. The winch 136 would then be operated to lower the pipe 142 into the trench 144 (step not shown in FIG. 5).

Figure 8:
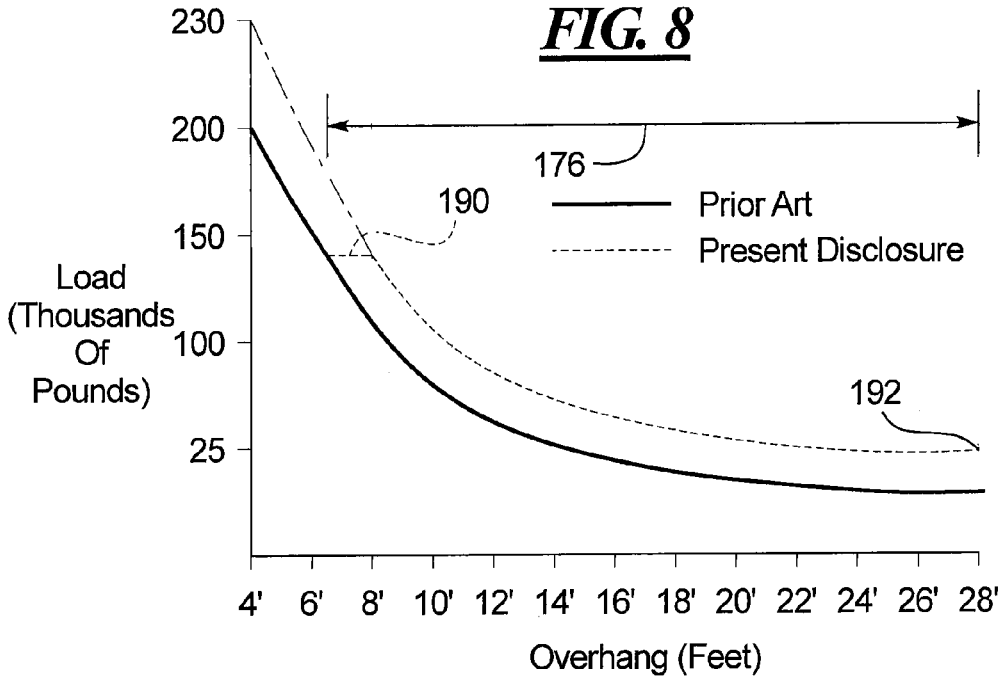
FIG. 8 is a chart similar to FIG. 7, but showing the improved lift curve of a pipelayer constructed in accordance with the teachings of this disclosure.

As the boom 124 is being extended, the position sensor may continually monitor the overhang distance 146 and decide as in step 174 if the overhang distance 146 is greater than the predetermined distance at which the pipelayer 100 enters a heavy-lift operating range 176 (see FIG. 8). As indicated above, this range is typically from six to twenty feet of overhang 146, but may be anywhere from four to twenty-eight feet (or more if the boom 124 is longer than twenty-eight feet). Ensuring the boom 124 is extended far enough so that the pipelayer 100 is in the heavy-lift operating range 176 is important because if the boom 124 is closer to the undercarriage 102, extension of the counterweight 148 at that time could potentially increase the maximum lifting capacity of the pipelayer 100 beyond its overall rating and thereby require the undercarriage 102, chassis 108, boom 124, and all associated machinery to be increased in size and strength to handle that increased load. As indicated above, as it would be desirable to use a conventionally sized undercarriage and other supporting structure, disabling the HLA 156 when the boom 124 is not in the heavy-lift operating range 176 satisfies both needs.

Referring again to FIG. 5, if the overhang distance 146 is in the heavy-lift operating range 176, the processor 160 will send a signal to the enable/disable/automatic switch 162 or other operator interface 164 informing the operator that heavy-lift capability is available as shown in step 178. If the overhang distance 146 is not in the heavy-lift operating range 176, the enable/disable/automatic switch 162 is not enabled as shown by step 180. Alternatively, the processor 160 may automatically keep the HLA 156 on or off.

Once heavy-lift capability is available, the operator can be provided with the option of engaging same as shown by step 182. If so, the processor 160 causes the hydraulic cylinder 154 to extend the counterweight 148 as shown in a step 184. The counterweight 148 may be fully deployed or be positioned to a distance to most effectively offset the moment created by the extended boom 124 and load supported by the extended boom 124. In addition to, or as an alternative to, adjusting the relative deployment position of the counterweight 148, the counterweight 148 can be hinged or separately provided to only deploy the weight needed to counteract the aforesaid moment. For example, if the counterweight 148 is provided in a series of plates 150 or other masses, less than all the counterweight 148 can be deployed.

Once deployed, the pipelayer 100 may continually monitor (as shown in a step 186) the overhang distance 146 to determine if it the boom 124 has retracted to a point where the pipelayer 100 is no longer in the heavy-lift operating range 176. If so, the processor 160 may cause the counterweight 148 to automatically retract as shown in a step 188.

Figure 7:
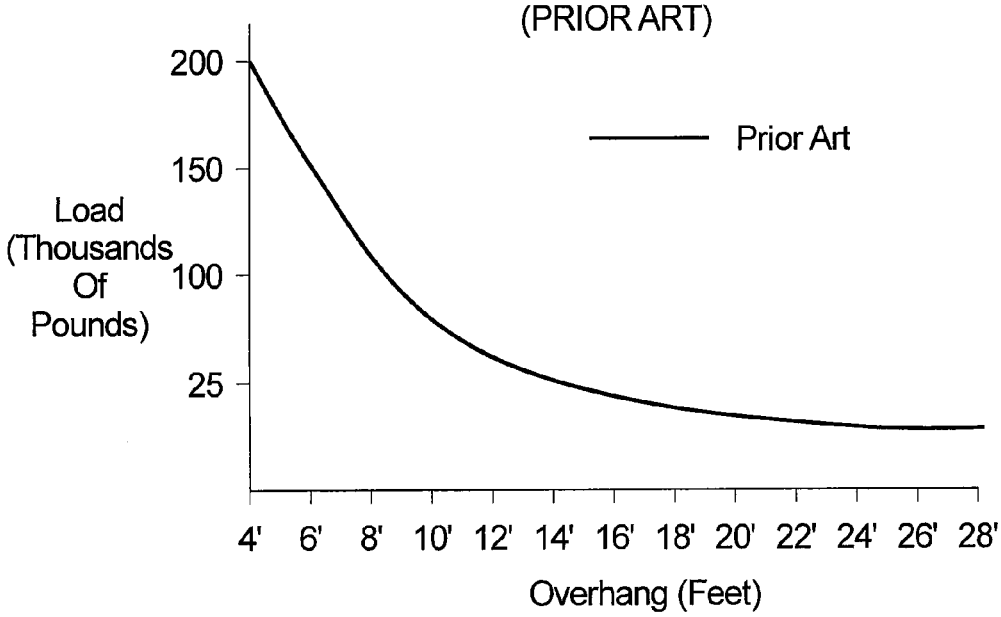
FIG. 7 (PRIOR ART)
FIG. 7 is a chart depicting the lift curve of a conventional pipelayer.

By providing such a system, the pipelayer 100 of the present disclosure is able to greatly increase its maximum lifting capacity across a large portion of its operating range. This is best shown in a comparison of FIGS. 7 and 8. FIG. 7 depicts a load curve for a prior art pipelayer listing the maximum lifting capacity on the vertical axis, and the overhang distance on the horizontal axis. As can be seen the pipelayer has its maximum lifting capacity (200,000 lbs. in the depicted embodiment) at an overhang distance of four feet. As the overhang distance increases it drops precipitously until reaching its minimum lifting capacity (25,000 lbs. in the depicted embodiment) at an overhang distance of twenty-eight feet.

However, as dramatically shown in FIG. 8, the maximum lifting capacity of the pipelayer 100, using the same size undercarriage 102 and engine 110 as the prior art example, may be increased by as much as 15% percent or more at all overhang distances 146 supported by the HLA system. In fact, the maximum lifting capacity at four feet of overhang 146 has been increased to roughly 230,000 pounds. Moreover, as it desirable to employ conventionally sized undercarriages 102 and other support structure, the pipelayer 100 of the present disclosure disables the HLA 154 until the overhang 146 has entered the heavy-lift operating range 176. The heavy lift operating range 176 differs depending on the size of the pipelayer 100, but is typically at a distance at which the lifting capacity of the pipelayer 100, even with the HLA deployed is still at or below the maximum lifting capacity of the pipelayer 100, thus enabling the load to be lifted without over-sizing or re-engineering the undercarriage 102 and other supporting structure of the pipelayer 100. FIG. 8 shows that the heavy-lift operating range 176 extending from eight feet to twenty-eight feet, but as indicated above, depending on design characteristics of the given pipelayer, the heavy-lift operating range 176 may be six to twenty feet, or anywhere from four feet to the entire length of the boom (twenty-eight feet in the depicted embodiment).

Couching the two curves of FIGS. 7 and 8 in machine production terms, two exemplary models of pipelayers manufactured by the present assignee have maximum lifting capacities of roughly 200,000 pounds and 230,000 pounds, respectively. Those pipelayers have overall machine weights of roughly 117,000 pounds, 151,000 pounds, respectively. By utilizing the teachings of the present disclosure, a pipelayer having roughly the size and weight of the smaller machine can now be produced having the ability to perform the same work as the larger machine in the working range. The foregoing data is of course only one example, and other sized machines and savings are possible within the scope of this disclosure. Nonetheless, from this example it can be seen that compared to conventional pipelayers having an undercarriage, chassis and boom weight of A, and a maximum lifting capacity of B, the present disclosure allows a pipelayer to be manufactured with an a maximum lifting capacity across the heavy lift operating range that is greater than B and at least as high as 1.15B, while still maintaining the weight as A. Moreover, not only can new pipelayers be built in this fashion, but by utilizing the HLA, existing pipelayers can be retrofit to have this added power as well.

While the maximum lifting capacity B of the pipelayer 100 is increased by the teachings of this disclosure, it is important to understand that the present disclosure disables the HLA 154 at cut-off 190 as shown in FIG. 8. In other words, even though the HLA could in theory be used to extend the maximum lifting capacity of the pipelayer 100 across the entire overhang range of 0-28 feet in the depicted curve, the HLA is only engageable across the heavy lift operating range 176. As shown, this results in a transition to a new curve which begins at cut-off 190 and extends to the maximum overhang point 192 of FIG. 8. The portion of the curve depicted in FIG. 8 for overhangs of four to eight feet is only provided to show the potential lifting capacity if the HLA were not disabled at the cut-off 190. If the HLA were not disabled once the overhang 146 dropped below the cut-off 190, the operator might try to lift a load which was beyond the maximum lifting capacity for which the undercarriage 102 is designed and result in structural damage to the pipelayer. By limiting the use of the HLA 154 to the heavy lift operating range 176, and disabling the HLA once the overhang 146 is less than the cut-off 190, the operator is able to lift a greater load across the relatively wide range of overhangs defined by the heavy lift operating range 176, without damaging the pipelayer 100 or requiring the pipelayer 100 to be manufactured with a larger undercarriage 102 to handle that load.

INDUSTRIAL APPLICABILITY

From the foregoing, it can be seen that the technology disclosed herein has industrial applicability in a variety of settings such as, but not limited to, increasing the lifting capacity of pipelayers without over-sizing or increasing the size of the undercarriage, engine, boom or other structures of the pipelayer. The pipelayer does so by providing additional counterweight, monitoring the position of the boom overhang, comparing that to the maximum load curve stored in memory, and only when the overhang distance increases to a point at which the resulting lifting capacity of the pipelayer is at or below the overall maximum lifting capacity, does the pipelayer allow a heavy lift attachment to deploy the counterweight. Deployment of the counterweight offsets the moment created by the extended boom and attached load of the pipe, thereby balancing the pipelayer while at the same time increasing its lifting capacity across a majority of its operating range.

While the foregoing has been made with primary reference to a pipelayer, it is to be understood that its teachings can be employed to increase the operating range of any number of similar vehicles including, but not limited to, loaders, excavators, lift trucks, cherry pickers, back-hoes, fork-lifts, or any other movable vehicle where a load is being lifted at a distance from the main body of the vehicle and thereby creating a moment tending to tip the vehicle.

What is claimed is:

1. A pipelayer, comprising:

an undercarriage;

a boom movable relative to the undercarriage;

a counterweight movable relative to the undercarriage ranging between fully deployed and fully retracted positions, the counterweight being deployable only when the boom has extended a predetermined distance from the undercarriage; and an operator interface and a position sensor, the operator interface indicating to an operator of the pipelayer that the counterweight can be deployed when the position sensor measures a boom overhang as being greater than the predetermined distance from the undercarriage.

2. The pipelayer of claim 1, wherein the predetermined distance is between six and ten feet from the undercarriage.

3. The pipelayer of claim 1, wherein the predetermined distance is between four and twenty-eight feet from the undercarriage.

4. The pipelayer of claim 1, wherein the counterweight is mounted on a hinged counterweight frame, the hinged counterweight frame having multiple positions between fully deployed and fully retracted.

5. The pipelayer of claim 1, wherein the weight of the counterweight is adjustable.

6. The pipelayer of claim 1, wherein the undercarriage and boom are designed for maximum lifting capacity at a boom overhang of four feet from the undercarriage and the lifting capacity of the pipelayer decreases past a boom overhang of four feet, and wherein the pipelayer has increased lifting capacity when the boom overhang is past four feet without increasing the size or weight of the undercarriage and the boom and without limiting the maximum lifting capacity of the pipelayer.

7. The pipelayer of claim 1, further including a processor in electronic communication with the position sensor.

8. The pipelayer of claim 7, wherein the operator interface is in electronic communication with the processor and enables the counterweight to be deployed when the position sensor detects the overhang distance has extended the predetermined distance.

9. The pipelayer of claim 8, further including a hydraulic cylinder operatively coupled to the counterweight, the processor automatically causing the hydraulic cylinder to retract the counterweight when the position sensor detects the boom overhang has become less than the predetermined distance.

10. A method of operating a pipelayer, comprising:

extending a boom away from an undercarriage;

measuring a distance the boom is extended away from the undercarriage;

deploying a counterweight only when the measured distance is greater than a predetermined length.

11. The method of claim 10, wherein the predetermined length is between six and ten feet.

12. The method of claim 10, wherein the predetermined length is between four and twenty-eight feet.

13. The method of claim 10, further including preventing the deployment of the counterweight until the measured distance is greater than the predetermined length.

14. The method of claim 13, further including retracting the counterweight when the boom is moved back toward the undercarriage to a distance less than the predetermined length.

15. The method of claim 14, wherein the retraction of the boom is automatically performed by the pipelayer.

16. The method of claim 10, wherein the counterweight is provided on a hinged counterweight frame, and wherein the counterweight frame can be deployed to a plurality of positions between fully deployed and fully retracted.

17. The method of claim 16, wherein the hinged counterweight frame has an adjustable weight.

18. A heavy lift assembly for a pipelayer, comprising:

a position sensor adapted to measure a parameter indicative of the distance a boom is extended away from an undercarriage of the pipelayer;

a processor receiving a measured parameter signal from the position sensor;

an operator interface connected to the processor and provided with an input device through which an operator can engage the heavy lift assembly, the input device being actuable only when the boom has extended away from the undercarriage by a predetermined distance.

19. The heavy lift assembly of claim 18, further including a counterweight hinged relative to the undercarriage.

20. The heavy lift assembly of claim 19, wherein the counterweight is movable to a plurality of positions between fully deployed and fully retracted.

21. The heavy lift assembly of claim 19, wherein the weight of the counterweight is adjustable.

22. The heavy lift assembly of claim 19, further including a hydraulic cylinder interconnecting the counterweight to the undercarriage.

23. The heavy lift assembly of claim 18, wherein the processor automatically retracts the counterweight when the measured parameter signal indicates the boom has been retracted to less than the predetermined distance away from the undercarriage.

24. The heavy lift assembly of claim 18, wherein the heavy lift assembly can be retrofit onto existing pipelayers without modifying the size or weight of the undercarriage and boom.

25. In a pipelayer having an undercarriage, chassis and boom weight of A and a machine maximum lifting capacity of B, a heavy-lift attachment adapted to increase the machine maximum lifting capacity to a value greater than B within a heavy lift operating range, while maintaining the undercarriage, chassis and boom weight as A, wherein the heavy-lift attachment includes a position sensor, a processor, an operator interface, and a counterweight.

26. The pipelayer of claim 25, wherein the maximum lifting capacity is increased to at least 1.15B.

27. The pipelayer of claim 25, wherein the heavy-lift attachment is retrofittable onto existing pipelayers.

28. The pipelayer of claim 25, wherein A is roughly 15,000 pounds and B is roughly 200,000 pounds.

* * * * *